United States Patent [19]

Beattie

[11] 4,133,289

[45] Jan. 9, 1979

[54] DEVICE FOR RECORDING CHANGES IN INDICIA

[76] Inventor: Robert W. Beattie, 9 Kipling Pl., Frankston, Victoria, Australia, 3199

[21] Appl. No.: 866,997

[22] Filed: Jan. 5, 1978

[30] Foreign Application Priority Data

Jan. 7, 1977 [AU] Australia ..... 8694/77

[51] Int. Cl.[2] ..... G09F 9/40

[52] U.S. Cl. ..... 116/309; 116/311; 40/377; 235/1 C; 116/317

[58] Field of Search ..... 116/133, 134, 120, 130, 116/129 R, 114 R, DIG. 3; 40/377, 493, 495, 111, 113, 5; 235/1 C, 117 A

[56] References Cited

U.S. PATENT DOCUMENTS

| | | | |
|---|---|---|---|
| 3,310,025 | 3/1967 | Egner | 116/133 |
| 3,722,461 | 3/1973 | Forman | 116/133 |
| 3,735,099 | 5/1973 | Herr | 116/133 |

FOREIGN PATENT DOCUMENTS

| | | | |
|---|---|---|---|
| 1447060 | 6/1966 | France | 116/129 R |
| 359048 | 1/1962 | Switzerland | 116/133 |

*Primary Examiner*—S. Clement Swisher
*Assistant Examiner*—Denis E. Corr
*Attorney, Agent, or Firm*—Andrus, Sceales, Starke & Sawall

[57] ABSTRACT

The present invention provides a device for recording successive changes in indicia including a support structure, a front wall portion supported by the support structure, a display opening in the front wall portion, a fulcrum horizontally disposed above the opening on the rear side of the wall portion, an annular member on the rear side of the wall portion and through which the fulcrum extends eccentrically such that the annulus, when resting under its own weight on the fulcrum, presents a portion of its circumference against the opening and constructed and arranged such that manually pushing the annulus away from its rest position results in pivoting about the fulcrum and thereafter, in returning to its rest position under its own weight, moves circumferentially with respect to the fulcrum to present an adjacent circumferential portion to the opening.

7 Claims, 9 Drawing Figures

(section A-A)

DEVICE FOR RECORDING CHANGES IN INDICIA

FIELD OF THE INVENTION

This invention relates to a device for recording changes in indicia and to a counter device. In a preferred aspect this invention relates to a score counter device.

In a particular aspect this invention relates to a device for recording successive changes in indicia, such as numerals. The device, in a one application is particularly suited to recording of progressive scores of one or more game players, such as the scores of table tennis, billiards or snooker players, or the scores in cards or board games.

In one form the device includes a support structure having a front wall portion in which a display opening is provided, an axle or pin means horizontally disposed above the opening on the rear side of the wall portion, and at least one ring member on the rear side of the wall member and through which the axle or pin means extends eccentrically such that the ring member when resting under its own weight on the axle or pin means presents a portion of its circumference against the opening.

SUMMARY OF THE INVENTION

The present invention provides a device for recording successive changes in indicia including a support structure, a front wall portion supported by the support structure, a display opening in the front wall portion, a fulcrum horizontally disposed above the opening on the rear side of the wall portion, an annular member on the rear side of the wall portion and through which the fulcrum extends eccentrically such that the annulus, when resting under its own weight on the fulcrum, presents a portion of its circumference against the opening.

PREFERRED FEATURES OF THE INVENTION

The annulus conveniently has a sequence of indicia around its outer circumference of which one of the indicia is visible through the opening, from the forward side of the wall portion, when the annulus is in its rest position. The arrangement may be such that by manually pushing the annulus away from its rest position at the opening, it moves circumferentially with respect to the fulcrum to present an adjacent circumferential portion to the opening after returning under its own weight, to its rest position.

There may be a plurality of such annuli.

The fulcrum may comprise a separate pin or axle for such annulus or, alternatively, a plurality of annuli may be mounted on a single pin or axle.

The or each annuli is supported by its associated fulcrum such that when in its rest position, the centre of the annulus is aligned with the opening, for example, substantially centrally thereof. Most conveniently, the width of the opening circumferentially of the annulus corresponds to the spacing between successive indicia, such that each time the annulus is pushed away from the opening, the annulus moves circumferentially to present the next indicium. It will be appreciated that where the indicia are the numerals 0 to 9, the numerals can be presented sequentially in increasing order.

The spacing of the fulcrum above and inwardly of the opening can vary with the dimensions, for instance radius, of the annulus and the radius of the fulcrum if it be a pin or axle. In general, it is desirable that the cross-sectional dimension of the axle or pin means is small in relation to that of the annulus, for example about one-eighth of the diameter of the ring. Moreover, with such relationship, the axle or pin means may be centered with respect to the annulus in its rest position, approximately one half and two-thirds of the internal radius of the annulus above and to one side, respectively, of the centre of the annulus.

The annulus may have a smooth outer circumference and rely on frictional engagement with the upper and lower edge of the opening, and possibly the portion of the fulcrum, to stop at successive rest positions. Additionally, at least the lower edge of the opening may be provided with a friction strip, for example of natural or synthetic rubber, to increase grip on the annulus each time a successive portion of the latter is advanced to the opening.

In an alternative form, the outer or inner circumference of the annulus may be such as to cause an engagement or latching. For instance, the outer circumference may be defined by a succession of substantially flat faces, such that the circumference is in the form of a regular polygon in side elevation and presents a successive face against the opening at each rest position. In a variation of that form, the annulus may be stepped in side elevation as a result of the lower edge of each face defining a shoulder projection radially over the adjacent face; such shoulder conveniently being such as to engage the lower edge of the opening to arrest circumferential movement of the annulus at each rest position.

Similarly, shaping of the inner circumference may result in interengagement with the fulcrum.

The device also may include an abutment means which the or each annulus engages to limit its movement when pushed away from the opening for movement to the next rest position. When so pushed, the annulus tends to pivot with some rotation about the point on its internal circumference in contact with the fulcrum and, when released, to drop under its weight to move that point toward the opening. The abutment means may be such as to limit such pivoting of the annulus to a constant value such that circumferential movement of the annulus is constant each time.

The abutment means may take a variety of forms, the prime requirement being that it limits pivoting of the annulus on the fulcrum. The abutment means may be on the diametrically opposed side of the annulus to the opening, in which case it may comprise a rear wall of a housing defining the support structure, on a member mounted on such wall, that is spaced from the annulus when in a rest position. Most conveniently, the abutment means is located above a portion of the annulus. In one form, the abutment means may comprise an upper wall of a housing defining the support structure, or a member mounted on such wall, that is spaced from the annulus when in a rest position. If the abutment means is a member mounted on such upper wall, it most conveniently is above the upper quadrant of the annulus remote from the front wall such that the annulus is pivotable on the fulcrum toward such member.

In a further form, the abutment means may comprise a member located within the inner circumference of the annulus such as to be engaged by the lower half of that circumference with such pivoting of the annulus. Such member may for example, comprise a shaft member extending axially of the annulus, most conveniently above the lower quadrant of the inner circumference nearer the front wall.

DETAILED DESCRIPTION

Figure 1:
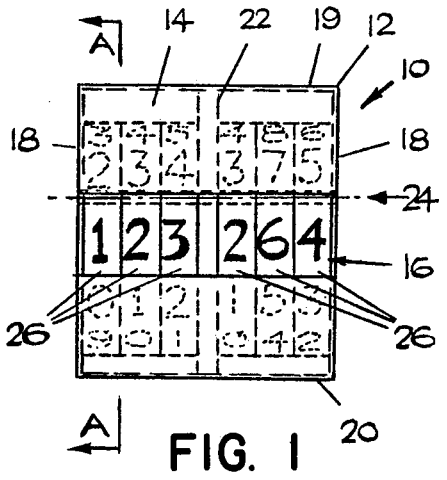
FIG. 1 is a front elevation of a dual counting device.

The device may be of a form suitable for recording successive scores of two or more players; there being a section of the device for each player with sufficient ring members to accommodate a possible score. The device of FIGS. 1 to 4 is suitable for use by two players and can accommodate a score total of up to 999.

The device 10 includes a rectangular housing 12 having a front wall 14, in which is provided a rectangular opening 16 for each section, and side, top, bottom and rear walls 18 to 21 respectively. Intermediate the side walls 18, and parallel therewith, is a partition 22 which divides the device into left and right hand sections.

Extending through each section is a common pin 24 which extends between the opposed side walls 18, through the partition 22. However, it will be appreciated that a respective pin may be provided in each section. The pin is horizontally disposed and located rearwardly of front wall 14, adjacent the upper edge of openings 16.

Within each of the sections of the housing, there is provided three ring members 26, each eccentrically supported on pin 24 and of a diameter that is large in relation to the spacing of the pin rearwardly of front wall 14. Due to this eccentric relation, the weight of the ring members tends to pivot them around their points of contact with pin 24, in a clockwise direction as viewed in FIG. 2, so that they press against the edges of their opening 16.

Figure 2:
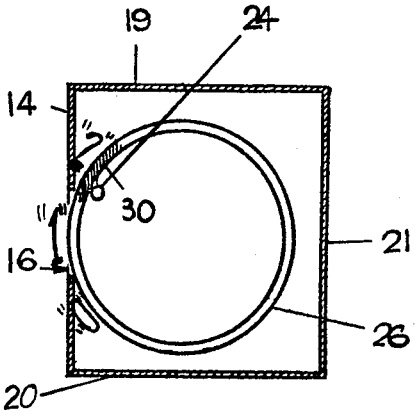
FIG. 2 is a section on line A — A of FIG. 1.
Figure 5:
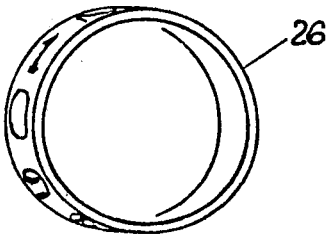
FIG. 5 is a perspective view of a ring member.

Each of the ring members is as shown in FIG. 5, from which it is seen that they each have numerals from "0" to "9" provided on, and uniformly spaced around, their circumferences in a clockwise direction as again viewed in FIG. 2. At the commencement of a game, the rings of each player's section are adjusted so that each presents its "0" at opening 16. As will be apparent, the height of the opening is such as to show only a single indicium of each ring.

Each ring may be moved circumferentially to present successive numbers "1" to "9" at opening 16. To effect such movement, a ring is pressed inwardly of its opening 16, as shown in FIG. 3 by a finger 29, and then released to assume a new rest position, as shown in FIG. 4, to present the next number (i.e. 2) at opening 16.

Figure 3:
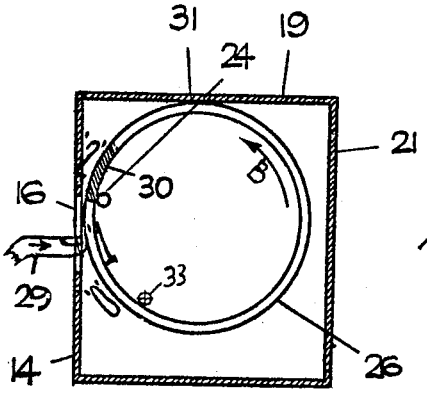
FIGS. 3 and 4 are views similar to FIG. 2 illustrating circumferential movement of a ring member to the next rest position to that of FIG. 1.
Figure 4:
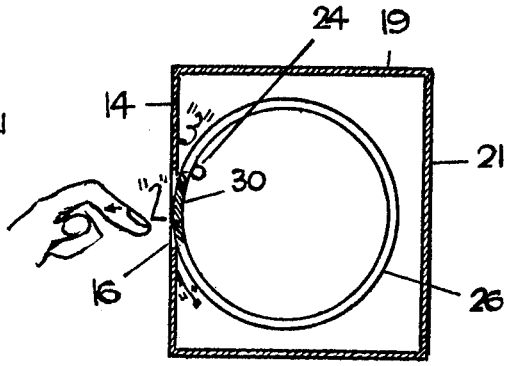

In FIGS. 2 to 4, it will be noted that such movement is indicated by the numerals shown for convenience adjacent the ring, as well as by the shaded section 30 shown (again simply for convenience) on the edge of the ring. Clearly, if the player utilizing the right hand section has a score as shown of "264" points and scores a further "13" points, his right hand ring must be moved on to show "7" by pressing that ring three times, while his central ring also must be moved on to also to show "7", but by being pressed only once.

In pressing the ring from the position shown in FIG. 2, to that of FIG. 3, the ring pivots on its contact with pin 24, with some rotation in the direction of the arrow B; the extent of such pivoting and rotation being limited by the ring abutting top wall 19 at 31. When released the ring falls to again rest on pin 24 with the portion of its circumference having the next number (in this case "2") being presented to its opening 16.

The device may be constructed of any suitable material. Thus, the housing may for example be of timber or plastics material; while the rings also may be of plastics material. The indicia, whether they be numbers as in the drawings, letters or other symbols, can be provided by any convenient method, such as casting or moulding, etching or engraving of the rings or by adhering a respective strip on which the indicia are provided around the circumference of each ring. In one convenient form, the indicia may be provided on a strip by traffolite labelling and adhered to a ring.

Finally, it is to be understood that various alterations, modifications and/or additions may be introduced into the constructions and arrangements of parts previously described without departing from the spirit or ambit of the invention.

Alternative constructions are shown in FIGS. 6–9 and like numerals as are used in FIGS. 1–5 denote like integers.

Figure 6:
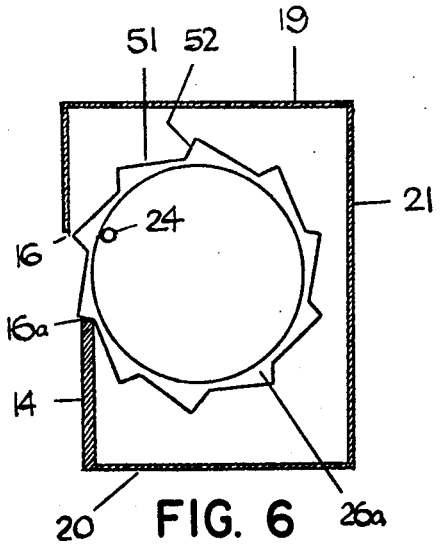
FIGS. 6–9 are sectional views corresponding to FIG. 2 but showing alternative constructions.

In the case of FIG. 6 the only difference is that the ring member **26*a* has a saw tooth profile with each tooth being comprised of a generally tangential flank 51 which will bear indicia and a generally normal flank 52. In use of the device of FIG. 6 the flanks 52 will abut against the material at 16*a* defining the lower side of the opening 16 and positively latch the flanks 51 in correct viewing position but when a user pushes against a flank 51 in like manner to FIG. 3, the flank 52 will disengage from the material at 16*a*** to permit rotation as before.

The construction of FIG. 6 has been found to be the most satisfactory in practice.

The angle of flanks 51 and 52 is preferably within plus or minus 20° of the tangents and normals with plus or minus 10° being more preferred and plus or minus 5° being still more preferred.

Figure 7:
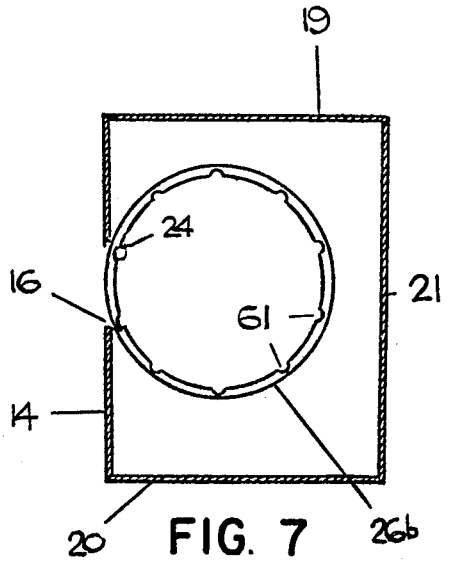

The construction of FIG. 7 differs from that of FIGS. 1–5 only in that the ring member **26*b* has internal notches 61 which engage with the pin 24. In this case superior positioning to the construction of FIGS. 1–5** is obtained.

Figure 8:
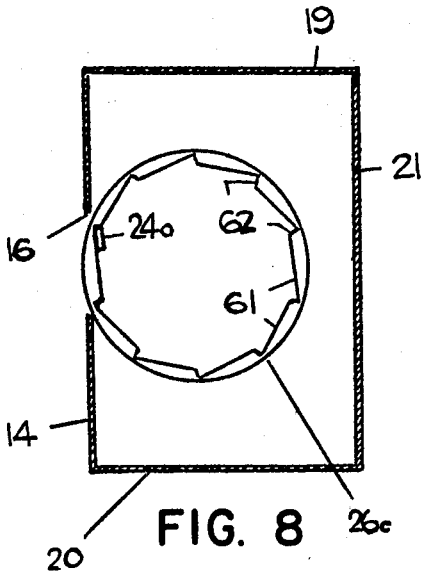

The construction of FIG. 8 differs from that of FIGS. 1–3 only in that the ring member **26*c* has internal saw teeth comprised of flanks 61 and 62 and the pin 24 is replaced by a member 24*a* shaped to engage with the flanks 62**.

Figure 9:
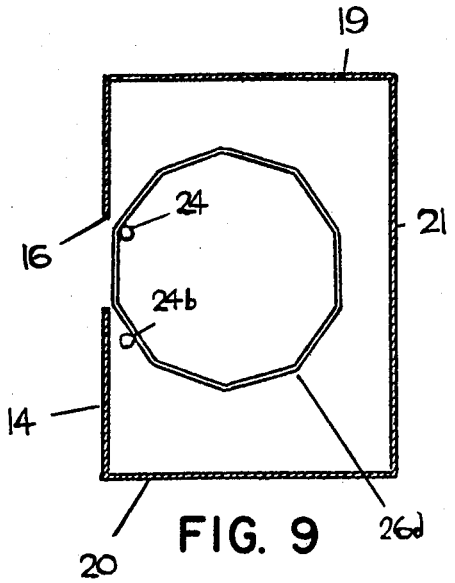

The construction of FIG. 9 differs from that of FIGS. 1–5 in that the ring member **26*d* is a decahedron and an additional pin 24*b*** is provided to assist positioning.

The claims form part of the disclosure of this specification.

Finally, it is to be understood that various alterations, modifications and/or additions may be introduced into the constructions and arrangements of parts previously described without departing from the spirit or ambit of the invention.

As additional modifications, the following may be applied.

A lamp or other lighting may be provided and conveniently is within the ring members which in this instance are preferably transparent or translucent.

Letters or any other indicia may be used in lieu of numerals.

The abutment provided at 31 may be located within the ring members such as by a member at 33.

In the construction of FIG. 6, the centre of the ring member 26*a*, when in repose, is preferably low with respect to the opening 16; for instance, approximately in line with 16*a*.

The claims form part of the disclosure of this specification.

I claim:

1. A device for recording successive changes in indicia including a support structure, a front wall portion supported by the support structure, a display opening in the front wall portion,, a fulcrum horizontally disposed above the opening on the rear side of the wall portion, an annular member on the rear side of the wall portion and through which the fulcrum extends eccentrically such that the annulus, when resting under its own weight on the fulcrum, presents a portion of its circumference against the opening and constructed and arranged such that manually pushing the annulus away from its rest position results in pivoting about the fulcrum and thereafter, in returning to its rest position under its own weight, moves circumferentially with respect to the fulcrum to present an adjacent circumferential portion to the opening.

2. A device as claimed in claim 1 wherein the annulus bears a sequence of indicia about its outer circumference.

3. A device as claimed in claim 1, wherein the annulus is supported such that when in its rest position the centre of the annulus is aligned with the opening.

4. A device as claimed in claim 1 wherein the inner surface of the annulus is provided with abutments adapted to releasably engage said fulcrum to define predetermined rotational positions of the annulus.

5. A device as claimed in claim 1 wherein the outer surface of the annulus is provided with abutments adapted to releasably engage material of the front wall to define predetermined rotational positions of the annulus.

6. A device as claimed in claim 5, wherein the outer surface of the annulus is provided with a saw-tooth profile and wherein flanks of said profile define said abutments.

7. A device as claimed in claim 1, and including an abutment means with which the annulus is adapted to engage to limit said pivoting to a substantially constant value whereby the movement circumferentially as aforesaid is of substantially constant value.

* * * * *